US007648447B2

(12) United States Patent
Andre

(10) Patent No.: US 7,648,447 B2
(45) Date of Patent: Jan. 19, 2010

(54) LEG EXERCISE DEVICE FOR USE WITH AN OFFICE CHAIR

(76) Inventor: Christian Saint Andre, 2805 Chicago St., San Diego, CA (US) 92117

( * ) Notice: Subject to any disclaimer, the term of this patent is extended or adjusted under 35 U.S.C. 154(b) by 0 days.

(21) Appl. No.: 10/698,295

(22) Filed: Oct. 31, 2003

(65) Prior Publication Data

US 2004/0142797 A1 Jul. 22, 2004

(51) Int. Cl.
*A63B 22/06* (2006.01)

(52) U.S. Cl. ..... 482/60; 482/904

(58) Field of Classification Search ..... 482/51–65, 482/70, 71, 101, 904, 908, 910, 80, 92, 94, 482/113, 114, 130, 138
See application file for complete search history.

(56) References Cited

U.S. PATENT DOCUMENTS 3,751,033 A * 8/1973 Rosenthal ..... 482/60
4,222,376 A * 9/1980 Praprotnik ..... 601/24
4,262,902 A * 4/1981 Dranselka ..... 482/60
4,390,177 A * 6/1983 Biran et al. ..... 482/60
4,739,984 A * 4/1988 Dranselka ..... 482/60
4,946,162 A * 8/1990 Lubie ..... 482/113
5,279,530 A * 1/1994 Hess ..... 482/70
5,743,838 A 4/1998 Willis
5,755,651 A 5/1998 Homyonfer et al.
5,807,212 A * 9/1998 Nelson ..... 482/60
5,833,575 A * 11/1998 Holslag ..... 482/51
5,855,538 A * 1/1999 Argabright ..... 482/70
5,921,900 A 7/1999 Mankovitz
6,063,012 A 5/2000 Berkowitz et al.
6,244,989 B1 * 6/2001 Chen ..... 482/57
6,712,737 B1 * 3/2004 Nusbaum ..... 482/8

* cited by examiner

*Primary Examiner*—Loan H Thanh
*Assistant Examiner*—Tam Nguyen
(74) *Attorney, Agent, or Firm*—Stephen C. Beuerle; Procopio Cory Hargreaves & Savitch LLP

(57) ABSTRACT

A leg exercise device for use with an office chair including a back, a seat, and a seat support. The leg exercise device includes a leg exercise mechanism for use by a user while seated on the office chair to exercise the user's legs, and a rigid connection mechanism extending from the leg exercise mechanism for detachably and rigidly connecting the leg exercise mechanism to the seat support of the office chair.

17 Claims, 5 Drawing Sheets

LEG EXERCISE DEVICE FOR USE WITH AN OFFICE CHAIR

FIELD OF THE INVENTION

The present invention relates, in general, to exercise devices for use with an office chair, and, in particular, to leg exercise devices for use with an office chair.

BACKGROUND OF THE INVENTION

Working in an office environment often requires workers to be seated for extended periods of time. It is well accepted that periodic exercise is desirable for good physical and mental health. However, performing exercise during a work day while seated is usually not practical or desirable. The inventor of the present invention has recognized that a worker is more likely to exercise while seated, improving the worker's mental alertness and long-term health, if the worker is presented with an exercise device that uses a type of motion that the worker is familiar with and not too difficult.

SUMMARY OF THE INVENTION

Accordingly, an aspect of the invention involves a leg exercise device for use with an office chair including a back, a seat, and a seat support. The leg exercise device includes a leg exercise mechanism for use by a user while seated on the office chair to exercise the user's legs, and a rigid connection mechanism extending from the leg exercise mechanism for detachably and rigidly connecting the leg exercise mechanism to the seat support of the office chair.

Further objects and advantages will be apparent to those skilled in the art after a review of the drawings and the detailed description of the preferred embodiments set forth below.

DETAILED DESCRIPTION OF PREFERRED EMBODIMENTS

Figure 1:
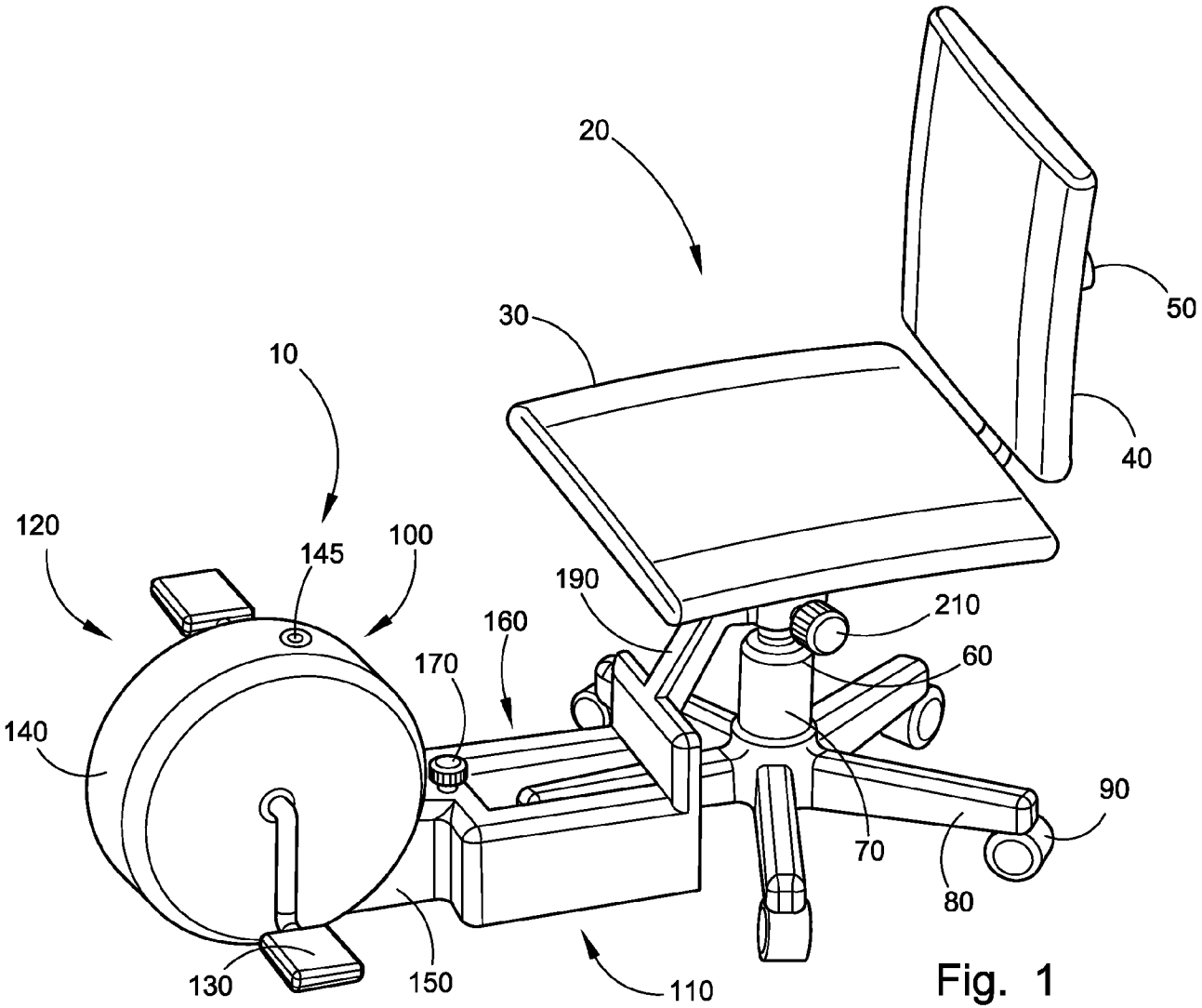
FIG. 1 is a perspective view of an embodiment of a leg exercise device connected to an exemplary office chair.
Figure 2:
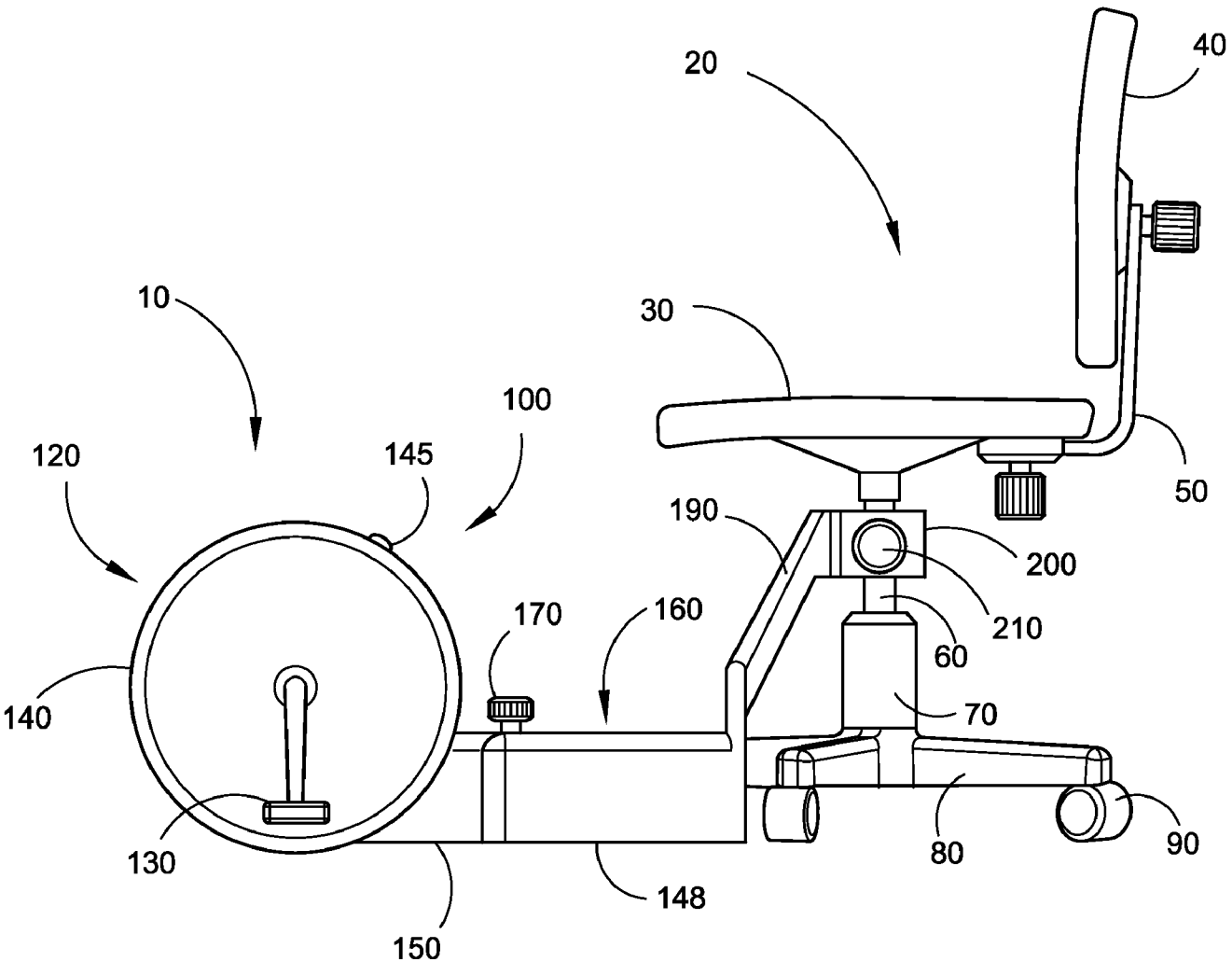
FIG. 2 is a right side-elevational view of the leg exercise device illustrated in FIG. 1 connected to the exemplary office chair.
Figure 3:
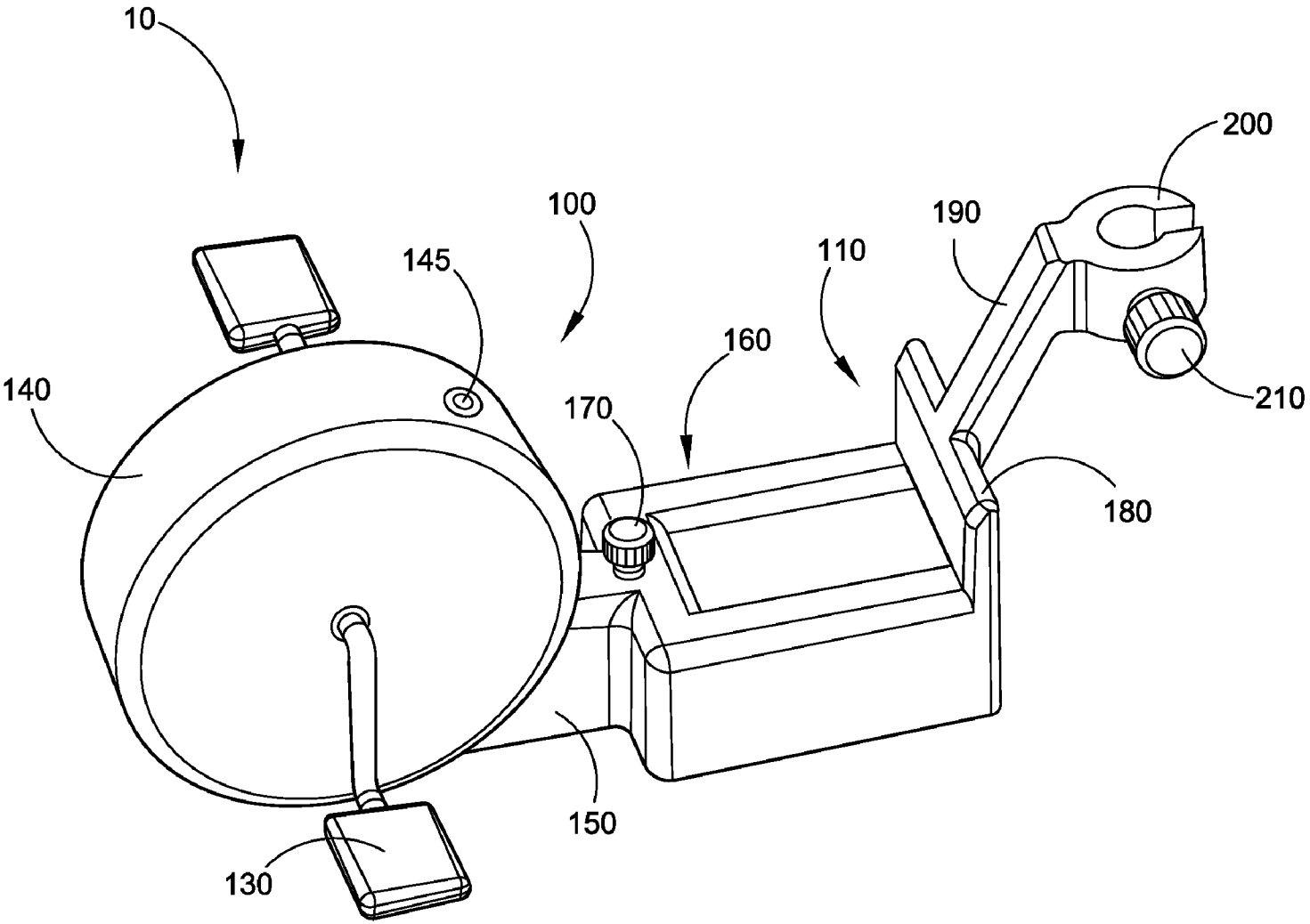
FIG. 3 is a perspective view of the leg exercise device illustrated in FIG. 1.

With reference to FIGS. 1-3, an embodiment of a leg exercise device 10 for use with an office chair 20 is shown. Although the leg exercise device 10 will be described in conjunction with an office chair 20, the leg exercise device 10 may be used in conjunction with other types of chairs or seating devices. The office chair 20 includes a seat 30, a back 40, a seat and back frame 50, a seat support 60, a seat support base 70, laterally extending arms 80, and casters 90. Although the office chair 20 is shown as including a single vertical seat support, in alternative embodiments the seat support 60 may include one or more vertical, horizontal, angled, and/or curved seat supports.

The leg exercise device 10 includes a leg exercise mechanism 100 and a rigid connection mechanism 110. In the embodiment shown, the leg exercise mechanism 100 is a pedaling mechanism 120 similar to that used with an exercise bike. The pedaling mechanism 120 includes opposite rotating pedals 130 that extend laterally from a drive housing 140. The pedaling mechanism 120 may include a difficulty control mechanism such as a tension control knob 145 for controlling the difficulty level of the pedaling mechanism 120. The drive housing 140 houses any well-known pedal drive known in the art. The pedal drive may allow both forward and reverse resistive pedaling. An underside of the pedaling mechanism 120 may include a slip-resistant rubber tread 148 to help hold the leg exercise device 10 on the floor. The leg exercise device 10 may include wheels and a handle grip to help transport the leg exercise device 10.

The rigid connection mechanism 110 is preferably made of a rigid metal or plastic material that provides a secure, rigid connection between the leg exercise mechanism 100 and the chair 20. The rigid connection mechanism 110 includes a first lateral arm 150 movably connected to a generally rectangular brace 160 for adjusting the lateral distance of the pedaling mechanism 120 from the office chair 20. A locking pin 170 may be used to lock the pedaling mechanism 120 in a desired position relative to the connection mechanism 110. A flange 180 extends vertically from the brace 160. An angled second arm 190 extends from the flange 180 and terminates in a penannular collar 200. The collar 200 includes a tightening pin 210 threadingly engaged to the collar 200 to lock the collar 200 to the seat support 60.

In use, the leg exercise device 10 is secured to the office chair 20 by positioning the leg exercise device 10 so that the pedaling mechanism 120 is located in front of the user when sitting and the rigid connection mechanism 110 is under the seat 30. An arm 80 may extend between opposite walls of the generally rectangular brace 160 for added stability. The collar 200 is secured to the seat support 60 by inserting the seat support 60 through the open portion of the penannular collar 200, and screwing the tightening pin 210 to tighten the tightening pin 210 against the seat support 60. The horizontal position of the pedaling mechanism 120 in front of the user may be adjusted to a desired position to accommodate the length of the user's legs by removing or pulling up on the locking pin 170 and sliding the pedaling mechanism 120 and first lateral arm 150 relative to the generally rectangular brace 160 until the pedaling mechanism 120 is at the desired location. The user may then use the leg exercise device 10 by sitting in the chair 20 and pedaling the pedaling mechanism 120. To remove the leg exercise device 10 from the chair 20, the tightening pin 210 is unscrewed, and the collar 200 is removed from the seat support 60.

Figure 4:
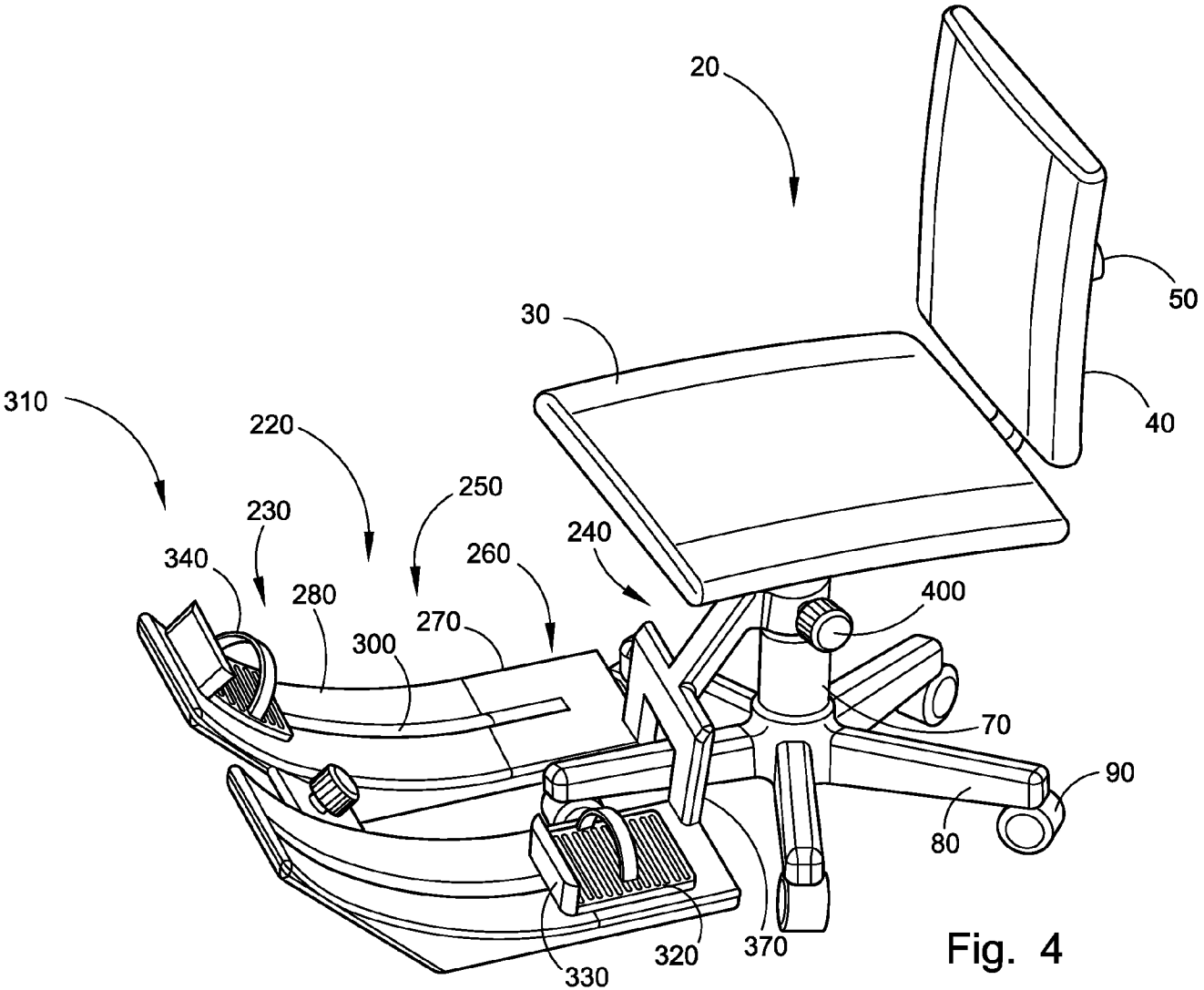
FIG. 4 is a perspective view of another embodiment of a leg exercise device connected to an exemplary office chair.
Figure 5:
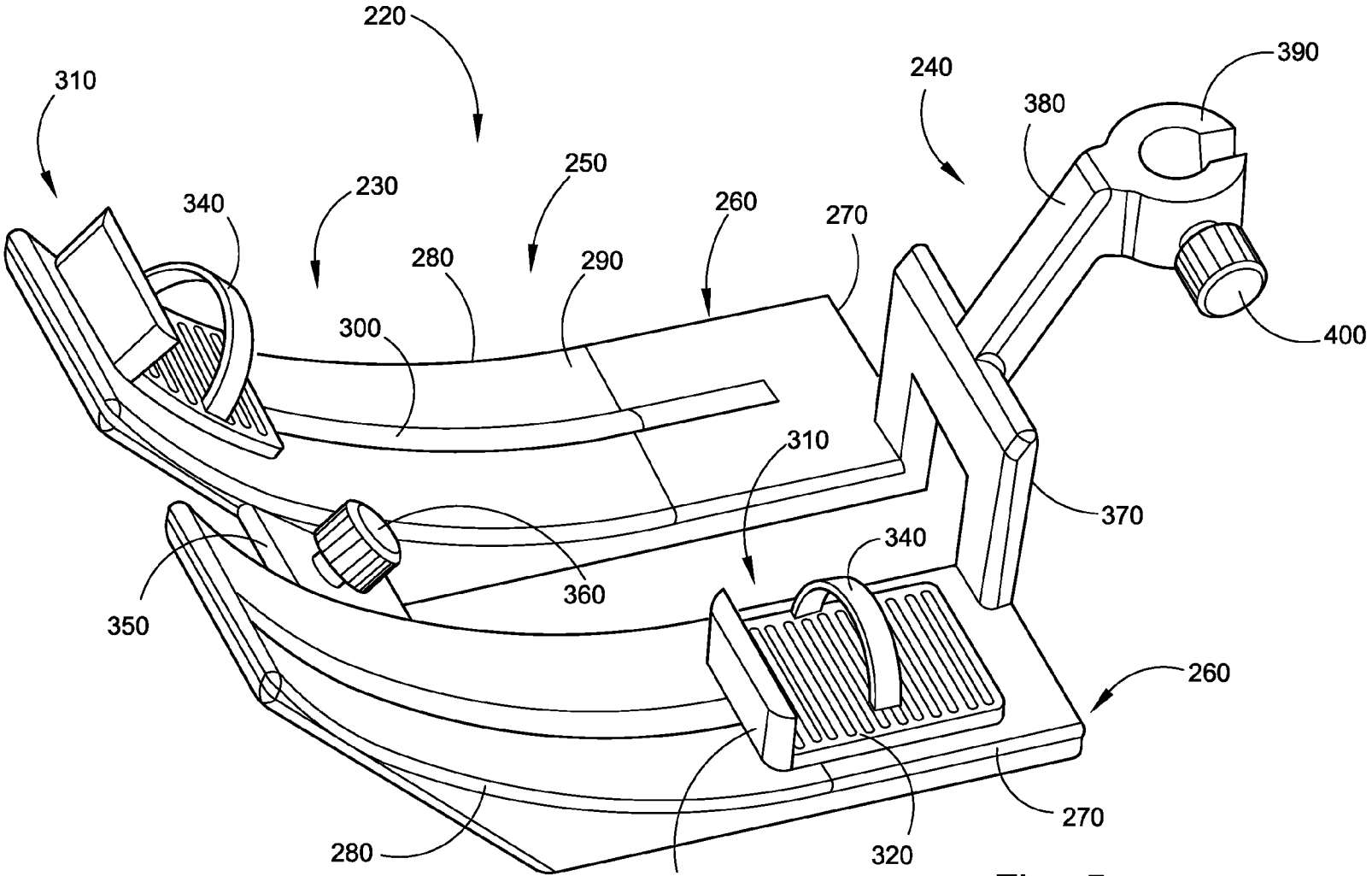
FIG. 5 is a perspective view of the leg exercise device illustrated in FIG. 4.

With reference to FIGS. 4 and 5, another embodiment of a leg exercise device 220 for use with the office chair 20 is shown. The leg exercise device 220 includes a leg exercise mechanism 230 and a rigid connection mechanism 240. In the embodiment shown, the leg exercise mechanism 230 is a sliding track mechanism 250. The sliding track mechanism 250 includes opposite upwardly curved tracks 260. Each track includes a substantially flat first track member 270 and an upwardly curved second track member 280. An upper surface 290 of the track members 270, 280 include an elongated groove 300. Foot members 310 are slidably connected to the tracks 260 at the grooves 300. Each foot member 310 includes a foot platform 320, a toe stop 330 vertically extending from a distal end of the foot platform 320 and a foot strap 340 connected to the foot platform 320 at opposite sides of the foot platform 320. The tracks 260 are distally connected with connection member 350. The connection member 350 may carry a difficulty control mechanism such as a tension control knob 360 for adjusting the tension or friction between the foot members 310 and the tracks 260 for controlling the difficulty of the leg exercise device 220. An underside of the sliding track mechanism 250 may include a rubber tread to help hold the leg exercise device 220 on the floor. The leg exercise device 220 may include wheels and a handle grip to help transport the leg exercise device 220.

The rigid connection mechanism 240 is preferably made of a rigid metal or plastic material that provides a secure, rigid connection between the leg exercise mechanism 230 and the chair 20. The rigid connection mechanism 240 includes a flange 370 that extends vertically from a proximal end of the tracks 260 and connects the proximal ends of the tracks 260. An angled arm 380 extends from the flange 370 and terminates in a penannular collar 390. The collar 390 includes a tightening pin 400 threadingly engaged to the collar 390 to lock the collar 390 to the seat support 60.

In an alternative embodiment of the rigid connection mechanism 240, the rigid connection mechanism 240 may include a arm similar to the first lateral arm 150 connected to the proximal ends of the tracks 260, and the first lateral arm 150 may be slidably attached to the rest of the rigid connection mechanism 240 for adjusting the length of the tracks 260 to accommodate users having different length legs.

The leg exercise device 220 is attached and detached from the office chair 20 in a manner similar to that described above for the leg exercise device 10 of FIGS. 1-3. The feet of the user are slipped through the foot straps 340 of the foot members 310 so that the toes of the user abut the to stop 330 and the user's feet are flat on the foot platforms 320. The user than causes the foot members 310 to slide or glide back and forth.

It will be readily apparent to those skilled in the art that still further changes and modifications in the actual concepts described herein can readily be made without departing from the spirit and scope of the invention as defined by the following claims.

What is claimed is:

1. A leg exercise device for use with an office chair including a back, a seat, a single vertical seat support with a lower portion; and a plurality of laterally extending arms radiating from the lower portion of the single vertical seat support, comprising:

a) a leg exercise mechanism for use by a user while seated on the office chair to exercise the users legs; and b) a rigid connection mechanism extending from the leg exercise mechanism for detachably and rigidly connecting the leg exercise mechanism to the seat support of the office chair, the rigid connection mechanism including a collar securable to the single vertical seat support of the office chair and a brace securable to one of the lateral extending arms for providing a secure, rigid connection between the leg exercise device and the office chair, wherein the brace is a generally rectangular brace with opposite walls configured to receive the one lateral extending arm securely between the opposite walls of the generally rectangular brace.

2. The leg exercise device of claim 1, wherein the leg exercise mechanism includes a pedaling mechanism that allows the user to pedal with the user's legs while seated on the office chair.

3. The leg exercise device of claim 2, wherein the pedaling mechanism includes a difficulty control mechanism to manually control the difficulty of pedaling.

4. The leg exercise device of claim 1, wherein the leg exercise device includes an undersurface with a slip-resistant tread that prevents the leg exercise device from slipping.

5. A leg exercise device for use with an office chair including a back, a seat, a single vertical seat support with a lower portion; and a plurality of laterally extending arms radiating from the lower portion of the single vertical seat support, comprising:

a) a leg exercise mechanism for use by a user while seated on the office chair to exercise the users legs; and b) a rigid connection mechanism extending from the leg exercise mechanism for detachably and rigidly connecting the leg exercise mechanism to the seat support of the office chair, the rigid connection mechanism including a collar securable to the single vertical seat support of the office chair and a brace securable to one of the lateral extending arms for providing a secure, rigid connection between the leg exercise device and the office chair, wherein the leg exercise mechanism includes a sliding track mechanism having tracks and foot members slidably attached to the tracks for allowing the user to glide the user's feet along the tracks while seated on the office chair.

6. The leg exercise device of claim 5, wherein the sliding track mechanism includes a difficulty control mechanism to manually control the difficulty of gliding.

7. The leg exercise device of claim 5, wherein the leg exercise device includes an undersurface with a slip-resistant tread that prevents the leg exercise device from slipping.

8. The leg exercise device of claim 1, wherein the collar is a penannular collar with a securing mechanism for securing the penannular collar to the single vertical seat support.

9. A leg exercise device for use with an office chair including a back, a seat, a single vertical seat support with a lower portion; and a plurality of laterally extending arms radiating from the lower portion of the single vertical seat support, comprising:

a) a leg exercise mechanism for use by a user while seated on the office chair to exercise the users legs; and b) a rigid connection mechanism extending from the leg exercise mechanism for detachably and rigidly connecting the leg exercise mechanism to the seat support of the office chair, the rigid connection mechanism including a collar securable to the single vertical seat support of the office chair and a brace securable to one of the lateral extending arms for providing a secure, rigid connection between the leg exercise device and the office chair, and a flange extending vertically from the brace, and an angled second arm extending from the flange and terminating in the collar.

10. The leg exercise device of claim 9, wherein the leg exercise mechanism includes a pedaling mechanism that allows the user to pedal with the user's legs while seated on the office chair.

11. The leg exercise device of claim 10, wherein the pedaling mechanism includes a difficulty control mechanism to manually control the difficulty of pedaling.

12. The leg exercise device of claim 10, wherein the leg exercise device includes an undersurface with a slip-resistant tread that prevents the leg exercise device from slipping.

13. The leg exercise device of claim 9, wherein the leg exercise mechanism includes a sliding track mechanism having tracks and foot members slidably attached to the tracks for allowing the user to glide the user's feet along the tracks while seated on the office chair.

14. The leg exercise device of claim 13, wherein the sliding track mechanism includes a difficulty control mechanism to manually control the difficulty of gliding.

15. The leg exercise device of claim 13, wherein the leg exercise device includes an undersurface with a slip-resistant tread that prevents the leg exercise device from slipping.

16. The leg exercise device of claim 9, wherein the collar is a penannular collar with a securing mechanism for securing the penannular collar to the single vertical seat support.

17. The leg exercise device of claim 9, wherein the brace is a generally rectangular brace with opposite walls configured to receive the one lateral extending arm securely between the opposite walls of the generally rectangular brace.

* * * * *

UNITED STATES PATENT AND TRADEMARK OFFICE

CERTIFICATE OF CORRECTION

PATENT NO. : 7,648,447 B2
APPLICATION NO. : 10/698295
DATED : January 19, 2010
INVENTOR(S) : Christian Saint Andre It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1176 days.

Signed and Sealed this

Twenty-third Day of November, 2010

David J. Kappos

David J. Kappos
*Director of the United States Patent and Trademark Office*